US008813651B1

(12) United States Patent
Hooke

(10) Patent No.: US 8,813,651 B1
(45) Date of Patent: Aug. 26, 2014

(54) METHOD OF MAKING SHAPED CHARGES AND EXPLOSIVELY FORMED PROJECTILES

(75) Inventor: Ryan Hooke, Sparta, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/332,867

(22) Filed: Dec. 21, 2011

(51) Int. Cl.

| | |
|---|---|
| ***F42B 1/036*** | (2006.01) |
| ***F42B 3/08*** | (2006.01) |
| ***F42B 12/10*** | (2006.01) |
| ***F42B 33/00*** | (2006.01) |

(52) U.S. Cl.
CPC ..... *F42B 1/036* (2013.01); *F42B 12/10* (2013.01); *F42B 3/08* (2013.01); *F42B 33/00* (2013.01)
USPC ..... 102/476; 86/51; 86/1.1

(58) Field of Classification Search
CPC ..... F42B 12/10; F42B 12/12; F42B 12/14; F42B 12/16; F42B 12/18; F42B 1/02; F42B 1/028; F42B 1/032; F42B 1/036; F42B 3/08; F42B 33/00; E21B 43/116; E21B 43/117
USPC ..... 102/305, 306, 307, 308, 309, 310, 475, 102/476; 86/51, 1.1
See application file for complete search history.

(56) References Cited

U.S. PATENT DOCUMENTS

| | | | | |
|---|---|---|---|---|
| 2,870,709 | A * | 1/1959 | Boelter, Jr. | 102/306 |
| 4,766,813 | A * | 8/1988 | Winter et al. | 102/307 |
| 5,175,391 | A * | 12/1992 | Walters et al. | 102/307 |
| 6,152,040 | A * | 11/2000 | Riley et al. | 102/306 |
| 7,278,353 | B2 * | 10/2007 | Langan et al. | 102/306 |
| 8,359,977 | B2 * | 1/2013 | Andrzejak | 102/206 |
| 2010/0307642 | A1 * | 12/2010 | Palumbo et al. | 148/518 |

* cited by examiner

*Primary Examiner* — James Bergin
(74) *Attorney, Agent, or Firm* — Michael C. Sachs

(57) ABSTRACT

A method of making a liner for a shaped charge or an explosively formed projectile may include making a liner substrate using a 3D additive manufacturing process. At least a portion of the surface of the liner substrate may be surface finished. The surface finished portion may be electroplated with a metal to form a multi-layer liner.

8 Claims, 3 Drawing Sheets

METHOD OF MAKING SHAPED CHARGES AND EXPLOSIVELY FORMED PROJECTILES

STATEMENT OF GOVERNMENT INTEREST

The inventions described herein may be manufactured, used and licensed by or for the U.S. Government for U.S. Government purposes.

BACKGROUND OF THE INVENTION

The invention relates in general to shaped charges and explosively formed projectiles or penetrators (EFPs) and in particular to methods of making shaped charges and EFPs.

Shaped charges may be one of the most efficient ways to defeat armor or fortified materiel. Liners for shaped charges may be made of a very dense material such as copper, tantulam, or the like. An explosive charge may be placed adjacent the liner. When the explosive charge is detonated, gas and pressure accelerate and shape the liner and transform the liner into a projectile. The projectile may have a very high velocity and, therefore, a very high kinetic energy. The high kinetic energy projectile may penetrate a large amount of material.

There are a number of conventional methods of making shaped charges. The performance of a shaped charge may depend not only on the type and quality of the material used to make the shaped charge, but may also depend on how the shaped charge is manufactured and assembled. Shaped charge liners may usually be machined, stamped or forged. Less-conventional methods of making shaped charges, such as casting and plasma spray, have also been tried. After a shaped charge liner has been manufactured, it may be used in a load and pack procedure to create a shaped charge. The shaped charge may include a high explosive material, a canister or container for holding a quantity of the high explosive in a predetermined orientation, and a liner.

Shaped charge liner shapes may be, for example, elliptical, fluted, conical, trumpeted, hemispherical, and linear. EFP liner shapes may be, for example, hemispherical or in the shape of a shallow bowl. Such shapes may be conveniently produced by additive manufacturing processes that use computer-aided design (CAD) software to generate three-dimensional (3D) objects, including geometrically complex 3D objects. Such additive processes may include, for example, stereolithography, 3D printing, selective laser sintering, direct metal laser sintering, and selective laser melting. These additive processes produce objects having anisotropic properties. However, anisotropic properties may be undesirable for shaped charge and EFP liners. Shaped charge and EFP liners and other components having isotropic properties may be more effective than components having anisotropic properties.

A need exists for a method of using CAD software and additive manufacturing processes to produce shaped charges, EFPs and components of shaped charges and EFPs.

SUMMARY OF THE INVENTION

It is an object of the invention to provide a method of using CAD software and additive manufacturing processes to produce shaped charges, EFPs and components of shaped charges and EFPs One aspect of the invention is a method of making a munition. The method may include making a liner substrate for the munition using an additive manufacturing process and surface finishing at least a portion of an entire surface of the liner substrate. The surface-finished portion may be electroplated with a metal to form a multi-layer liner.

The munition may be one of a shaped charge and an explosively formed projectile. The liner substrate may be made of a non-metallic material.

Surface finishing may include polishing a portion of the entire surface. The method may include, after polishing and before electroplating, applying a conductive layer to a portion of the surface of the liner substrate.

Before applying the conductive layer, the method may include hermetically sealing a portion of the surface of the liner substrate.

Electroplating may include electroplating a portion with a metal so that a thickness of the metal is in a range of about 0.0001 inches to about 0.1875 inches.

After electroplating, the method may include removing the liner substrate to form a single layer metal liner.

Surface finishing may include polishing substantially the entire surface of the liner substrate. Electroplating may include electroplating substantially the entire surface of the liner substrate with the metal to form the multi-layer liner. The liner substrate may be removed from the multi-layer liner to form a metal liner having a hollow wall. The hollow wall may be filled with a material other than air.

In one embodiment, the method may include separating an outer metal layer from the liner substrate to form a first single-layer metal liner, and separating an inner metal layer from the liner substrate to form a second single-layer metal liner.

Another aspect of the invention is a munition having a liner made in accordance with the inventive method.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1A:
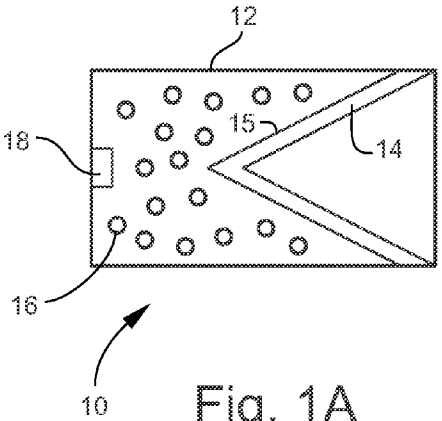
Fig. 1A PRIOR ART
FIG. 1A is a side schematic view of a known shaped charged.

FIG. 1A is a side schematic view of a known shaped charged 10. Shaped charge 10 may include a container or canister 12, a liner 14, high explosive material 16 disposed between a rear surface 15 of liner 14 and canister 12, and a detonator 18. The shape of liner 14 may be, for example, elliptical, fluted, conical, trumpeted, hemispherical, or linear.

Figure 1B:
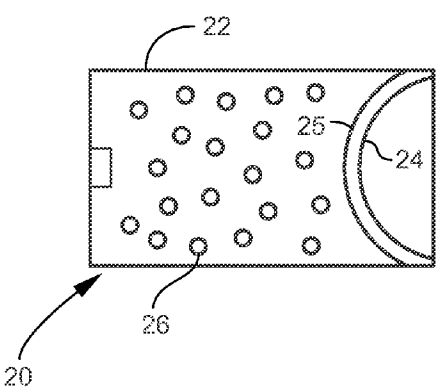
Fig. 1B PRIOR ART
FIG. 1B is a side schematic view of a known EFP.

FIG. 1B is a side schematic view of a known EFP 20. EFP 20 may include a container or canister 22, a liner 24, high explosive material 26 disposed between a rear surface 25 of liner 24 and canister 22, and a detonator 28. The shape of liner 24 may be, for example, hemispherical or in the shape of a shallow bowl.

Methods of making shaped charge liners, EFP liners, shaped charges, and EFP muntions may include the use of CAD software and additive manufacuring processes. The additive manufacturing processes may produce 3D metallic objects or 3D non-metallic objects, such as objects made of, for example, plastics or epoxy. The additive manufacturing processes may be used to manufacture a shaped charge or EFP, or components thereof, such as liners. Some components may be made of non-metallic materials and then electroplated.

A metal liner made using a 3D additive process and CAD software may be loaded, assembled and packed into a munition without further processing. A metal 3D liner's terminal ballistics capabilities may be further enhanced by electroplating the metal 3D liner with copper or another metal to produce a multi-layer liner.

Figure 2A:
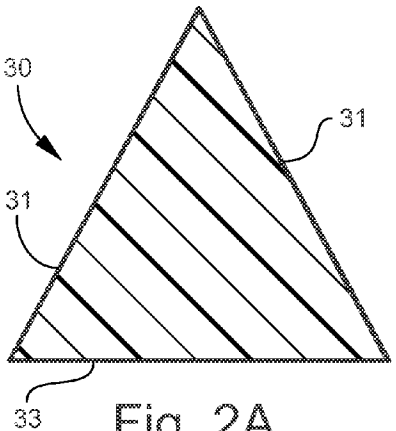
FIG. 2A is a sectional view of a non-metallic solid cone made by an additive manufacturing process.
Figure 2B:
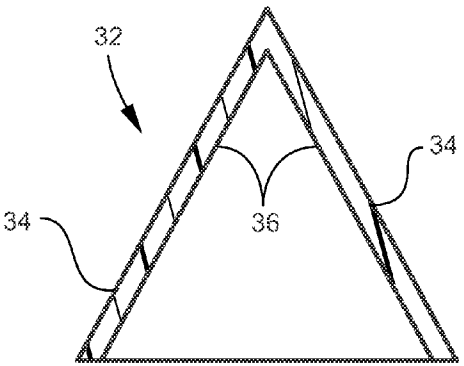
FIG. 2B is a sectional view of a non-metallic hollow cone made by an additive manufacturing process.

A liner made from a non-metallic material, for example, a plastic, may have little terminal ballistics capabilities. However, a liner substrate made from a non-metallic material may be formed using an additive process and CAD software, such as a 3D printing process. The non-metallic material may be a specially selected plastic made of organic compounds that are designed to enhance high explosive effects. Acrylonitrile butadiene styrene (ABS), for example, may be a suitable plastic. The liner substrate may be 3D printed as a solid shape, such as the solid cone 30 of FIG. 2A, or as a hollow shape, such as the hollow cone 32 of FIG. 2B.

After 3D printing a non-metallic liner substrate, such as cones 30 or 32, the surface of the 3D liner substrate may be surface finished. In some embodiments, the surface finishing process may be polishing. Polishing may be performed, for example, mechanically or chemically. Polishing may create a smooth surface that is conducive to electroplating. The degree of polishing may determine the surface roughness of the liner substrate. The surface roughness of the liner substrate adjacent the electroplated metal may affect the surface roughness and mechanical structure of the electroplated metal. The surface roughness of the liner substrate adjacent high explosive material may affect the interaction of the high explosive with the liner.

In the case of, for example, solid cone 30, the side or conical exterior surface 31 may be polished, but the base 33 need not be polished. In the case of hollow cone 32, the exterior conical surface 34 may be polished and, in some embodiments, the interior conical surface 36 may also be polished.

If the 3D printing is performed at a low density setting, the non-metallic liner substrate may have a "honeycomb" type of internal structure. After the desired surfaces of a low density non-metallic liner substrate are polished, the polished surfaces may be hermetically sealed, using, for example, epoxy or urethane.

In addition to polishing, the surface finishing process may also include increasing the surface roughness by, for example, mechanical means such as bead blasting. The surface finish may be varied from one portion of the 3D liner substrate surface to another. The amount of penetration of shaped charges and EFPs may be related to the surface finish of the liner. One may tailor the surface finish of the non-metallic liner substrates to tailor the amount of penetration. For example, high surface finish values may be the result of large discontinuities in the liner substrate surface and small surface finish values may be the result of an absence of discontinuities on the liner substrate surface. For example, a 1000 micro inch surface finish may produce a jet which penetrates less than one with a surface finish of 125 micro inches. For EFPs, surface finish variations may be used to make discontinuities along the surface that may cause the liner to break into multiple projectiles.

Thus, by varying the surface finish of a non-metallic liner substrate prior to electroplating the substrate, one may vary the way in which a shaped charge jet forms, to thereby control the penetration of the shaped charge. Similarly, a multiple projectile EFP may be created by producing stress fields in the liner. The stress fields may be produced by varying the surface finish of the EFP liner substrate. The metal that is electroplated on the liner substrate may mimic the underlying surface finish of the liner substrate. A more uniform or homogenous metal plating may be created by rotating the liner substrate during the electroplating operation.

The non-metallic liner substrate may be electroplated with copper or another metal to produce a multi-layer liner. Electroplating may enhance the terminal ballistics of the multi-layer liner. All or a portion of the non-metallic liner substrate may be electroplated. The thickness of the metal coating may be, for example, in a range of about 0.0001 inches to about 0.1875 inches. Partial electroplating may be achieved by, for example, applying a conductive spray to only the portion of the substrate that is desired to be electroplated. Or, adhesive tape may be applied to a portion of the substrate and, after the entire substrate is electroplated, the tape and the electroplating on top of the tape may be removed.

Figure 3B:
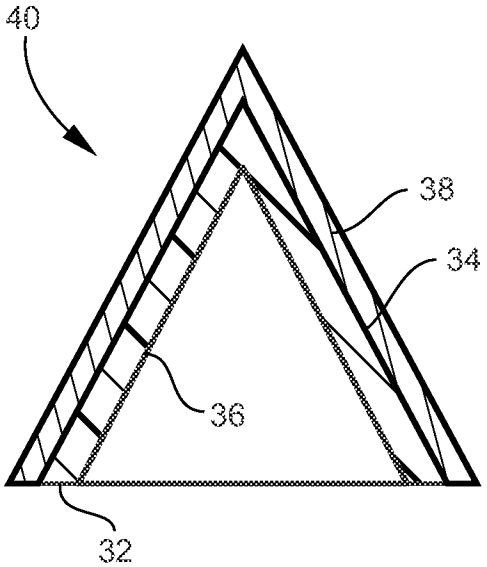
FIGS. 3A-D shows the non-metallic cones of FIGS. 2A-B with electroplating.
Figure 3A:
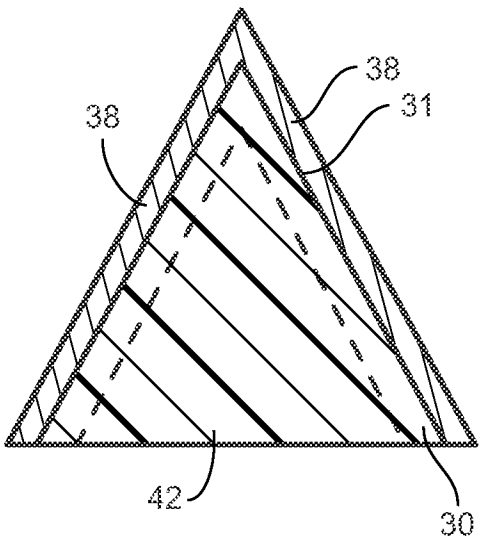

In FIG. 3A, side or conical surface 31 of solid cone 30 has been electroplated with a metal 38. A portion 42 (shown in dashed lines) of the interior of solid cone 30 may be removed to create a multi-layer liner with a metal exterior and a non-metallic interior. The multi-layer liner may be used as a liner in a shaped charge or EFP, such as those in FIGS. 1A-B. The multi-layer liner may be substituted for, for example, liner 14 or liner 24. Or, all of solid cone 30 may be removed by, for example, dissolving cone 30 with a chemical (for example, acetone) or by melting cone 32. Then, metal cone 38 may be used as a single-layer liner.

Further, non-metallic solid cone 30 may be used as a mold or mandrel to create metal cone 38. In this instance, non-metallic cone 30 may be made of a material that has no adhesion to metal 38. After cone 30 is electroplated, metal cone 38 may be removed from non-metallic cone 30 and used as a liner.

In FIG. 3B, exterior conical surface 34 of hollow cone 32 has been electroplated with metal 38 to form a multi-layer liner 40. Interior conical surface 36 has not been electroplated. Multi-layer liner 40 may be used as a liner in a shaped charge or EFP, such as those in FIGS. 1A-B. Liner 40 may be substituted for, for example, liner 14 or liner 24. In another embodiment, non-metallic hollow cone 32 may be removed from metal cone 38 by, for example, dissolving cone 32 with a chemical (for example, acetone) or by melting cone 32. Then, metal cone 38 may be used as a single-layer liner.

Figure 3D:
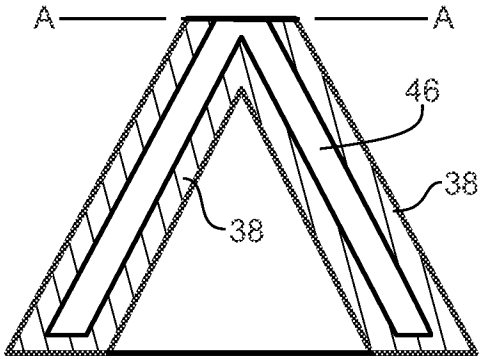
Figure 3C:
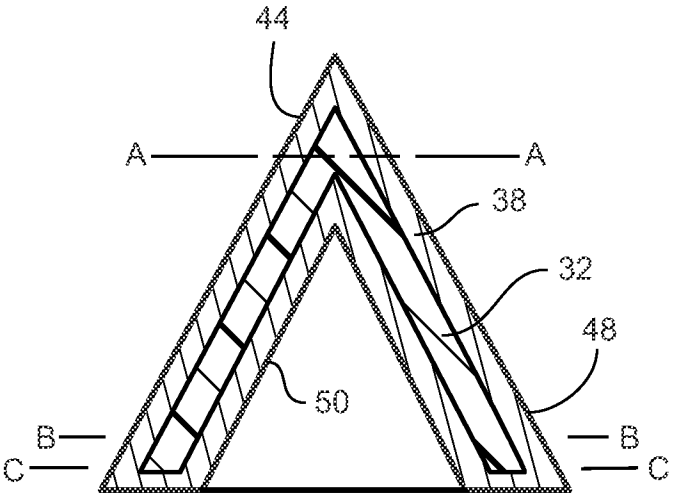

In FIG. 3C, all or substantially all of the surfaces (including both inside surface and outside surface) of the non-metallic hollow cone 32 have been electroplated with metal 38. Inside surface coating in FIG. 3C has been captioned as being number 50, but it could also be considered as being 38 as in FIG. 3D. A tip portion 44 of metal 38 and hollow cone 32 may be removed by, for example, cutting along a horizontal plane AA. Then, the remainder of hollow cone 32 may be removed by, for example, dissolving cone 32 with a chemical (for example, acetone) or by melting cone 32. The resulting structure (FIG. 3D) is a hollow-walled, hollow metal cone with a truncated tip. The void 46 created by removing substrate cone 32 may be filled with, for example, high explosive 16 and the liner may be used in a self-tamped shaped charge or EFP. Or, void 46 may be filled with high density materials such as powdered metals, a mixture of powdered metal and polymer, alloys, a mixture of alloys and polymers, reactive materials, etc. and the liner may be used in a shaped charge of EFP.

Because solid or hollow shapes made of non-metallic material may be readily produced by additive processes such as 3D printing, one may produce a single size of a certain shape using a 3D additive process, and then post process the single size into other variations. For example, given a single size of a cone 30 or 32, smaller sized cones may be produced by slicing the cone 30 or 32 on a plane that is perpendicular to the longitudinal axis of the cone. The different sized cones may then be processed for electroplating as discussed above. This process is much faster and cheaper than known processes for making different sized liners.

Another method of making multiple liners utilizes the embodiment of FIG. 3C. Tip portion 44 is not removed. A cut may be made only through an outer metal layer 48 at horizontal plane BB. Outer metal layer 48 may then be separated from non-metallic hollow cone 32 and used as a single-layer metal liner. An inner metal layer 50 may be cut along horizontal plane CC and separated from non-metallic hollow cone 32 to produce a second, substantially identical single-layer metal liner.

Additionally, additive manufacturing processes such as 3D printing may be used to create non-conventional liner shapes. If manufactured using conventional methods, non-conventional liner shapes may require special tooling. For example, the manufacture of fluted liners requires a female and a male tool with very precise interactions for cold working operations, and the cold working operations often require several drawing processes and heat treatments to create the final liner dimensions. On the other hand, complex liner substrate shapes with tolerances controlled to the thousandths of an inch may be made using a non-metallic material and a 3D additive process. The complex substrate shapes may then be plated (either partially or completely encapsulated) to a desired thickness. The desired plating thickness may be controlled to the tens of thousandths of an inch. The resulting multi-layer liner may be used as is with the non-metallic substrate. Or, the non-metallic substrate may be removed to produce a single-layer metal liner. Or, in the case of a non-metallic substrate that is completely encapsulated within metal electroplating, the non-metallic substrate may be removed to create a metal liner with a hollow wall. The hollow wall may be filled with material such as high explosive, for example.

Another advantage of using a non-metallic substrate may be compliance with insensitive munitions requirements. When a non-metallic substrate is encapsulated in metal plating, the non-metallic substrate may, when heated, expand at a faster rate than the explosive material in the munition. Thus, the multi-layer liner may expand and cause a crack or fissure in the canister of the shaped charge of EFP. The crack or fissure may provide a vent for gases produced by the high explosive and may prevent unwanted detonation of the high explosive.

In another aspect of the invention, metallic liners or metallic liner substrates for shaped charges and EFPs may be formed using 3D additive processes. To produce a high-density, isotropic, single-layer metal liner with a 3D additive process may require a very high power laser and high density nano powders and alloys. But, an anisotropic metallic liner substrate may be more easily produced using a 3D additive process. An anisotropic metallic liner substrate may be made from, for example, stainless steel, tool steel, cobalt chromium, titanium, or aluminum. An anisotropic metallic liner substrate may be electroplated with an isotropic metal plating to create a multi-layer metallic liner. The multi-layer metallic liner may possess the isotropic properties in the proper location required for efficient shaped charged and EFP performance.

If the anisotropic metallic liner substrate is produced by a 3D additive process that sinters the metal, then the metallic liner substrate may be electroplated without further processing. If the anisotropic metallic liner substrate is produced by a 3D additive process that does not sinter the metal, then the metallic liner substrate may be hermetically sealed using, for example, epoxy, prior to being electroplated. With either a sintered or unsintered metallic liner substrate, the surface finish of the substrate may be varied, as described with reference to non-metallic liner substrates.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A method of making a munition, comprising:

making a liner substrate for the munition using CAD software and a 3D additive manufacturing process;

surface finishing and electroplating at least a portion of an entire surface of the liner substrate; and electroplating the portion of the surface of the liner substrate with a metal, to form a multi-layer liner.

2. The method of claim 1, wherein said liner has a defined point-like tip area, with said tip area having a defined apex thereof, and wherein surface finishing includes polishing substantially the entire both inner and outer surfaces of the liner substrate.

3. The method of claim 2, wherein electroplating includes electroplating substantially the entire both inner and outer surfaces of the liner substrate with the metal to form the multi-layer liner.

4. The method of claim 3, further comprising removing the material of the liner substrate from the multi-layer liner to form a metal liner having a hollow wall, comprising the steps of:

simultaneously removing a portion of the tip area of the added electroplated metal surface and a like portion of the tip area of the non-metallic hollow substrate, by cutting along a parallel plane, and then;

removing the liner substrate material from the multi-layer liner to form such metal liner having a hollow wall.

5. The method of claim 4 wherein the material is removed by dissolving it with a chemical.

6. The method of claim 5 wherein the chemical is acetone.

7. The method of claim 4 wherein the material is removed by melting it.

8. The method of claim 4 wherein the parallel plane is below the lowest apex of the liner substrate tip, and plane perpendicular to the cone's central axis.

* * * * *